US006516989B1

(12) United States Patent
Sun

(10) Patent No.: US 6,516,989 B1
(45) Date of Patent: Feb. 11, 2003

(54) MAGAZINE ASSEMBLY FOR STAPLING GUNS

(75) Inventor: Pel Chang Sun, Taichung (TW)

(73) Assignee: Regitar Power Tools Co., Ltd., Taichung (TW)

( * ) Notice: Subject to any disclaimer, the term of this patent is extended or adjusted under 35 U.S.C. 154(b) by 0 days.

(21) Appl. No.: 08/968,474

(22) Filed: Nov. 12, 1997

(51) Int. Cl.[7] ..... B25C 1/04
(52) U.S. Cl. ..... 227/120; 227/109
(58) Field of Search ..... 227/109, 120, 227/135, 136, 119

(56) References Cited

U.S. PATENT DOCUMENTS 3,510,043 A * 5/1970 Larson ..... 227/109
4,304,349 A * 12/1981 Novak et al. ..... 227/109
4,524,896 A * 6/1985 Morrell, Jr. ..... 227/120
4,801,062 A * 1/1989 Austin ..... 227/120
5,433,367 A * 7/1995 Liu ..... 227/120
5,653,371 A * 8/1997 Hou ..... 227/109
5,704,532 A * 1/1998 Wey ..... 227/109

* cited by examiner

*Primary Examiner*—Scott A. Smith
(74) *Attorney, Agent, or Firm*—A & J

(57) ABSTRACT

An improved magazine assembly for stapling guns includes a magazine housing, a housing cover, and an elastic follow member. The magazine housing has two plate surfaces. At one plate surface there is provided a series of track blocks along the length of the magazine housing. A nail exit is formed at the magazine housing near the machine head. A vertical slot is formed in the magazine housing parallel to the track blocks. The elastic follow member is installed within the magazine housing and includes a push plate and a spring connected to the push plate. The push plate lies against the track blocks and displaces along their surface, and further extends through the vertical slot to the other plate surface of the magazine housing to form a bent trigger plate. The trigger plate has a hook that hooks one end of the spring. The other end of the spring is secured at the bottom end of the magazine housing. The housing cover is transparent and is disposed on the magazine housing where the track blocks are provided. The housing cover is transparent and has a through slot to allow the user to inspect the amount of nails inside the magazine.

1 Claim, 4 Drawing Sheets

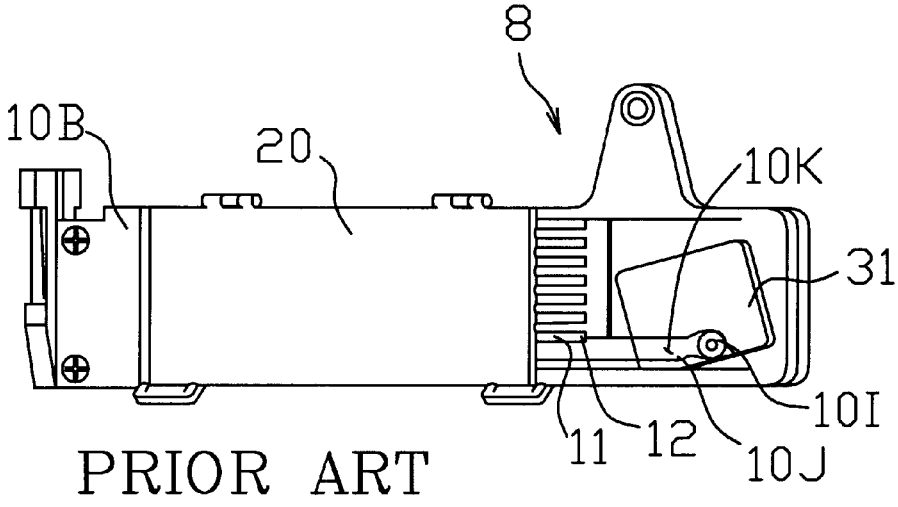
PRIOR ART
FIG. 3
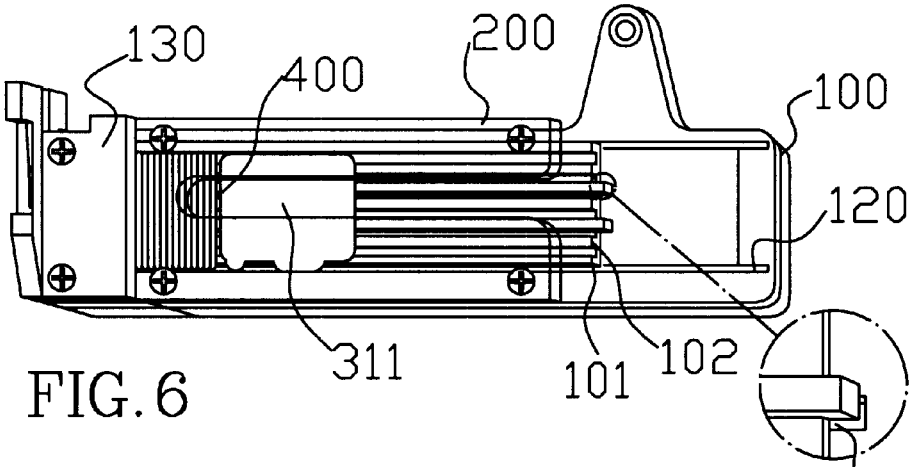
FIG. 6
FIG. 6A
113
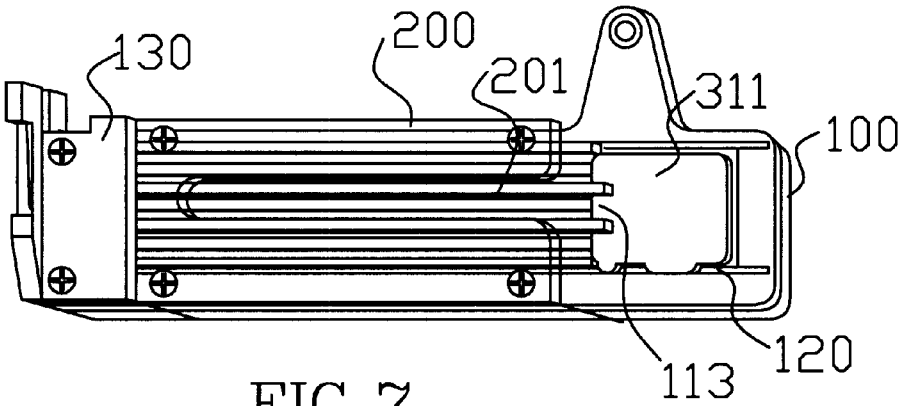
FIG. 7

MAGAZINE ASSEMBLY FOR STAPLING GUNS

BACKGROUND OF THE INVENTION

1. Field of the Invention

The present invention relates to a nailing machine, and more particularly to an improved magazine assembly.

2. Description of the Prior Art

FIG. 1 shows a conventional stapling device which is often shaped like a gun. In a gun-shaped housing 1, a strike pin 2, a reset spring 3, a magnetic barrel 4, a control circuit 5, and a press switch 6 are disposed. There is further provided a machine head 7 at the front end of the housing 1 adapted to insertably clamp nails, the machine head 7 being connected to a magazine 8 at a lower end thereof. One end of the strike pin 2 extends in to the magnetic barrel 4 with the other end urging against the spring 3, which in turn urges against a magnetic barrel 4 electrically connected to the control circuit 5 and the press switch switch 6. When the press switch 6 is pressed, the strike pin 2 is attracted by the magnetic barrel 4 into the machine head 7, striking the nails in the magazine 8 out of the nailing machine.

FIG. 2 shows the detailed structure of the above-described nailing machine of the prior art. It essentially comprises a magazine housing 10, a magazine cover 10, and an elastic follow member 30. At one plate surface of the housing 10 along the length thereof, there are provided a series of track blocks 11, 12, . . . (see FIG. 3). A cover plate 10B is screwably locked above the track blocks 11, 12, . . . at that end of the housing 10 near where the machine head 7 is fixedly disposed. A nail exit 10A is defined between the cover plate 10B and the track blocks 11, 12, . . . . A through slot 10C is formed near and parallel to the track blocks 11, 12, . . . , connecting the two halves of the housing 1. Near the bottom end of the housing 10, the through slot 10C forms a curved portion 10I, and a notch 10J is formed at a front rim thereof. The elastic follow member 30 is comprised of a push plate 31, and a trigger plate 32 screwably locked thereto. The trigger plate 32 is connected to the spring 33. At a base of the trigger plate 32 near the housing 10, a hook 32A is formed to hook the spring 33. The spring 33 passes over a roller 10D on the housing 10 and is secured at a pin 10E at the bottom end of the housing 10. Where the push plate 31 screwably joins the trigger plate 32, it extends through the through slot 10C. A a retaining block 10K is projectingly disposed at the front end of the part of the push plate 31 where it is screwably joined to the housing 10 so that the push plate 31 lies against the track blocks 11, 12, . . . (see FIG. 3) and is always in the state of displacing toward the nail exit 10A to push the nails on the track blocks 11, 12, . . . Where the housing 10 is provided with the track blocks 11, 12, . . . , there is further provided a magazine cover 20, which is smaller than the length of the housing 10. One lateral end of the cover 10 is provided with pivot joints 10F for pivotal connection with the housing 10. The other lateral end is provided with retaining notches 10G. Elastic hooks 10H may be used to engage the retaining notches 10G and the walls of the housing 10 for securing purposes.

As shown in FIG. 3, by pulling the trigger plate 32 (see FIG.2), the push plate 31 displaces towards the curved portion 10I and tilts, so that the retaining block 10J falls into the notch 10J and is secured therein to facilitate installing of nails on the track blocks 11, 12, . . . . Then the trigger plate 32 is pulled to cause the push plate 31 to be released from the grip of the notch 10J and push the nails out. However, the above-described conventional nailing machine has the following drawbacks:

1. Since the notch is on the curved portion of the through slot and holds the push plate at a single point only, the moving push plate will deflect and be biasedly engaged in the notch. As the engagement is not firm, the push plate may easily be shaken out of position upon impact and spring back, which will pose danger to the user if he/she is installing nails in the magazine.

2. As the housing cover is assembled to the housing by means of pivot joints at one side and retaining notches at the other side, when there is jamming, the housing cover has to be pivotally turned open to allow clearing of the jammed nails. Constant opening will result in damage to the relevant portions.

3. The housing cover is not transparent and do not allow the user to inspect the amount of the nails inside the magazine. It is necessary to open the magazine in order to know how many nails are left in the magazine, which is very inconvenient and inefficient.

SUMMARY OF THE INVENTION

The present invention relates to a nailing machine, and more particularly to an improved magazine assembly.

A primary object of the present invention is to provide an improved magazine assembly, in which some of the track blocks on the magazine have their rear ends project rearwardly to form clamping portions in which one end of the push plate can be firmly engaged so that the push plate will not easily slip out of position upon impact to cause danger to the user.

According to the improved magazine assembly of the present invention, the housing cover is assembled to the housing by screws and is provided with a through slot in the middle along the length thereof. When there is jamming, the push plate is firstly fixed in position and a small tool can be inserted into the through slot to clear the jammed nails on the track blocks. There is no need to remove the housing cover as in the prior art.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF DESCRIPTION OF THE DRAWINGS

FIG. 3 is a schematic sectional view showing the positioning of the push plate of the nailing machine of the prior art;

FIG. 6 is a schematic view illustrating the feeding and pushing of the nails in the present invention;

FIG. 6A is an enlarged fragmentary view of FIG. 6; and

FIG. 7 is a schematic view illustrating the positioning of the push plate of the present invention.

DETAILED DESCRIPTION OF THE PREFERRED EMBODIMENT

Figure 1:
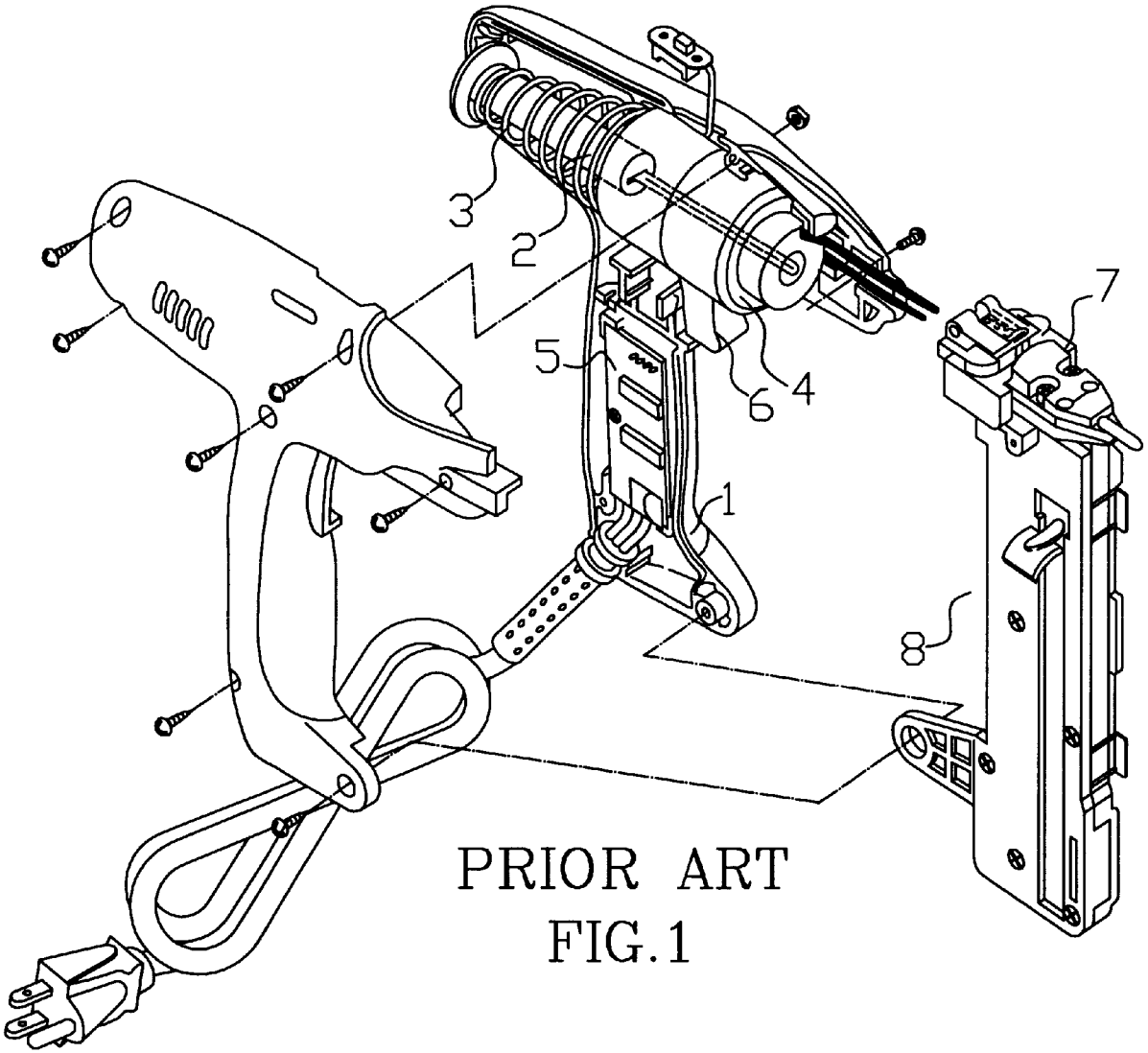
PRIOR ART FIG. 1
FIG. 1 is a perspective exploded view of nailing machine of the prior art.
Figure 2:
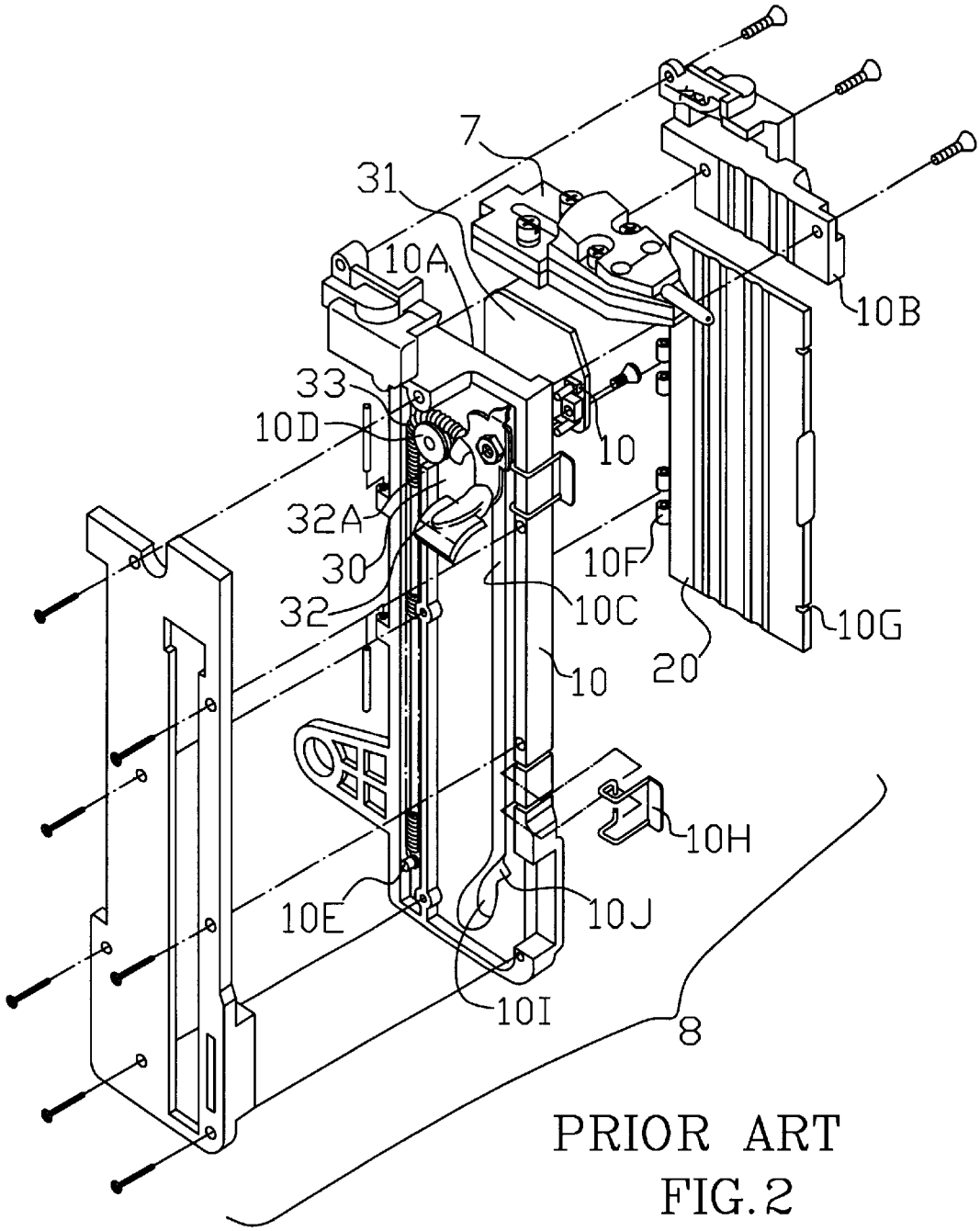
PRIOR ART FIG. 2
FIG. 2 is a perspective exploded view of the magazine assembly of the nailing machine of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
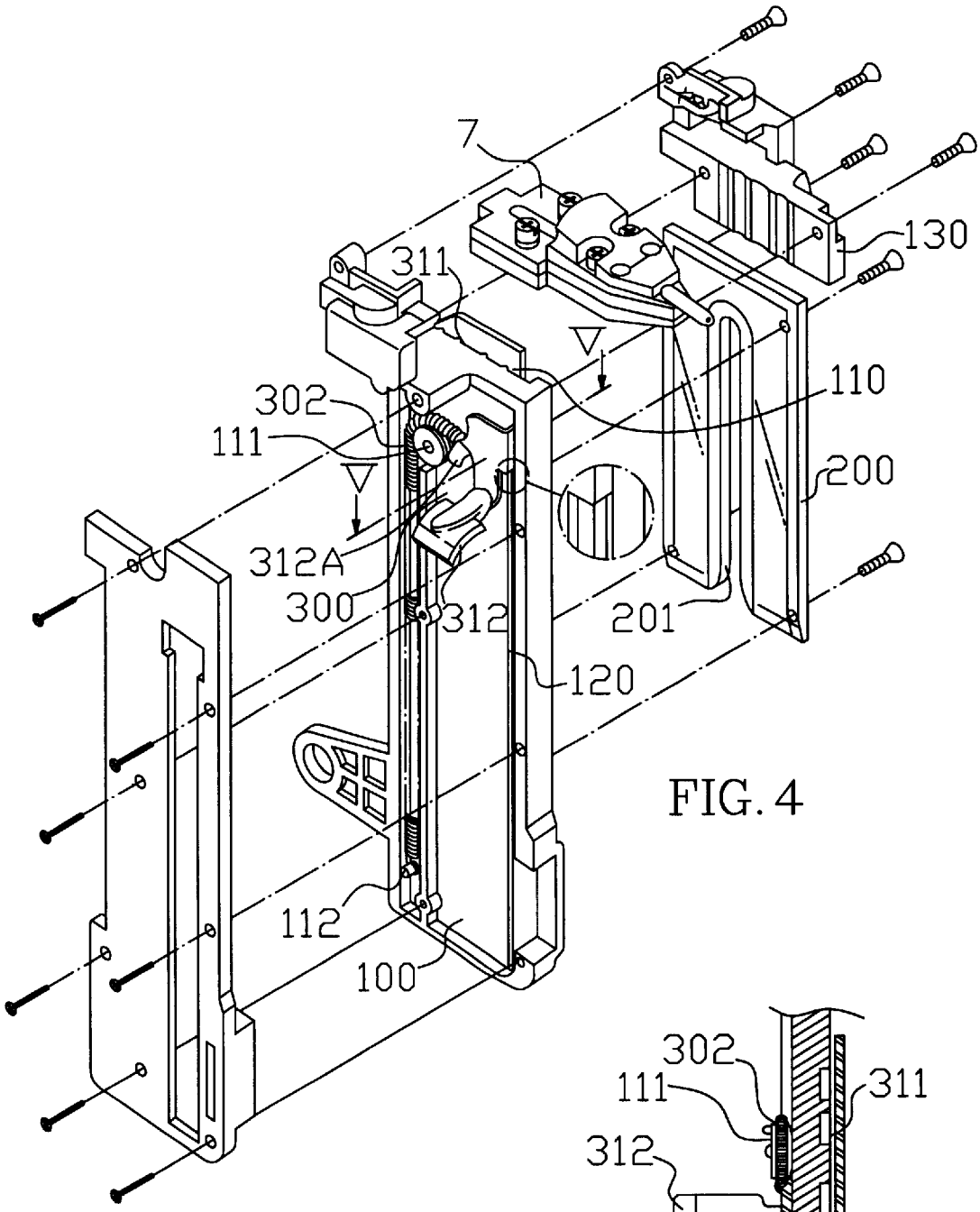
FIG. 4 is a perspective exploded view of the present invention.
Figure 5:
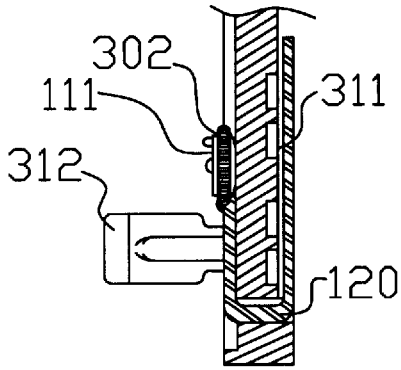
FIG. 5 is a sectional view taken along line V—V of FIG. 4.

As shown in FIG. 4, the present invention comprises a magazine housing 100 having two plate surfaces, a housing cover 200, and an elastic nail follow member 300. The magazine housing 100 is provided with a series of track blocks 101, 102, . . . at one plate surface along the length thereof (see FIGS. 6 and 7). A cover plate 130 is screwably locked above the track blocks 101, 102, . . . at one end of the magazine housing 100 near where the machine head 7 is screwably fixed, such that a nail exit 110 is defined between the cover plate 130 and the track blocks 101, 102, . . . A vertical slot 120 is further formed in the magazine housing 100 parallel to the track blocks 101, 102, . . . The elastic nail follow member 300 is mounted within the magazine housing 100 and comprised of a push plate 311 and a spring 302 connected to the push plate 311. The push plate 301 may rest against the track blocks 101, 102, . . . and displace along their surface; the push plate 311 further extends through the vertical slot 120 to the other plate surface of the magazine housing 100 to form a bent trigger plate 312, as shown in FIG. 5. The trigger plate 312 includes a base and a hook 312A formed near the magazine housing 100 at a suitable position for hooking one end of the spring 302. The other end of the spring 302 passes over a roller 111 on the magazine housing 100 to a pin 112 at a bottom end the magazine housing 100 and is secured thereby. Therefore, the push plate 311 is always inclined to displace towards the nail exit 110. The housing cover 200 is screwably fixed to the magazine housing 100 where the track blocks 101, 102, . . . are. The housing cover 200 is transparent and has a through slot 201 having a width smaller than that of the nails formed in the middle along the length thereof.

Referring to FIGS. 6 and 6A, after nails 400 are installed on the track blocks 101, 102. . . , the resilience of the push plate 311 pushes the nails 400 the clearance between the housing cover 200 and the track blocks 101, 102, . . . ready for nailing. Since the housing cover 200 is transparent, the user may look at the nails 400 inside the magazine and know their amount. In addition, some of the track blocks have their rear ends projecting rearwardly such that the iprojected portions form clamp openings 113 with the surface of the rear end of the magazine housing 100, the clamp openings 113 being sized to allow the push plate 311 to squeeze thereto. When nails are being installed, or when jamming is being cleared, referring to FIG. 7, by pulling the trigger plate 312 (shown in FIGS. 4 and 5), the push plate 311 is caused to withdraw so that one end thereof fall into the clamp opening 113 and is firmly secured therein. After the push plate 311 has been secured, the user can use a pointed tool to extend into the through slot 201 and clear the jammed nails 400. (For the placement of the nails 400, please refer to FIG. 6.) Then by pulling the trigger plate 312 slightly to the back, so that the push plate 311 is released from the clamp opening 113, the push plate 311 will spring back, as shown in FIG. 5. There is no need to disconnect the housing cover 200 from the magazine housing 100 at one side as in the prior art.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A magazine assembly for stapling guns comprising:

a magazine housing having two plate surfaces, said magazine housing being provided with a series of track blocks at one plate surface along the length thereof, a nail exit at an end where a machine head is disposed, a vertical slot formed in said magazine housing parallel to said track blocks to allow communication between said two plate surfaces;

a housing cover, screwably disposed on said one plate surface of said magazine housing where said track blocks are provided, said housing cover being provided with a through slot at the middle along the length thereof; and an elastic follow member, installed within said magazine housing, wherein said elastic follow member is comprised of a push plate and a spring, said push plate lying against said track blocks and displacing along their surface, said push plate further extending through said vertical slot to another plate surface of said magazine housing to form a bent trigger plate, said trigger plate having a base forming a hook near said magazine housing at a suitable position for hooking one end of said spring, another end of said spring being secured at an inner wall of said magazine housing so that said push plate is always urged to displace towards said nail exit;

wherein a certain number of said track blocks have rear end portions of a reduced thickness, which project rearwardly such that they define clamp openings with a surface of a rear end of said magazine housing, said clamp openings capable of holding firmly a part of said push plate which is squeezed thereinto.

* * * * *